United States Patent [19]

Peters et al.

[11] Patent Number: 4,877,722

[45] Date of Patent: Oct. 31, 1989

[54] COLOR PHOTOGRAPHIC RECORDING MATERIAL DEVELOPABLE BY HEAT

[75] Inventors: Manfred Peters; Manfred Becker; Kaspar Wingender, all of Leverkusen; Thomas Kaluschke, Leichlingen; Sieghart Klötzer, Cologne, all of Fed. Rep. of Germany

[73] Assignee: AGFA-Gevaert Aktiengesellschaft, Leverkusen, Fed. Rep. of Germany

[21] Appl. No.: 293,533

[22] Filed: Dec. 30, 1988

Related U.S. Application Data

[63] Continuation of Ser. No. 50,674, May 18, 1987, abandoned.

[30] Foreign Application Priority Data

May 30, 1986 [DE] Fed. Rep. of Germany ..... 3618141

[51] Int. Cl.[4] ..... G03C 5/54; G03C 7/26

[52] U.S. Cl. ..... 430/559; 430/203; 430/217; 430/567; 430/617; 430/619

[58] Field of Search ..... 430/203, 567, 617, 619, 430/217, 559

[56] References Cited

U.S. PATENT DOCUMENTS

| | | | |
|---|---|---|---|
| 4,433,048 | 2/1984 | Solberg et al. | 430/567 |
| 4,477,564 | 10/1984 | Cellone et al. | 430/567 |
| 4,495,277 | 1/1985 | Becker et al. | 430/567 |
| 4,565,778 | 1/1986 | Miyamoto et al. | 430/567 |
| 4,581,327 | 4/1986 | Habu et al. | 430/567 |
| 4,590,155 | 5/1986 | Klotzer | 430/567 |
| 4,636,461 | 1/1987 | Becker et al. | 430/567 |
| 4,668,614 | 5/1987 | Takada et al. | 430/567 |
| 4,695,525 | 9/1987 | Tsukase et al. | 430/203 |
| 4,696,887 | 9/1987 | Sato et al. | 430/203 |

OTHER PUBLICATIONS

Chem. Abstr. No. 102: 53827f, 1985; Abst. of Japanese OPI 59/52,237 published 3/1984.

Chem. Abstr. No. 100: 183118v, 1984, Abstr. of D.E. 3,229,999; published 2/1984.

*Primary Examiner*—Richard L. Schilling

*Attorney, Agent, or Firm*—Connolly and Hutz

[57] ABSTRACT

A heat developable color photographic recording material is improved in its $D_{min}/D_{max}$ ratio and sensitivity if it contains a silver halide emulsion in which the grains have at least three zones differing in their silver halide composition.

8 Claims, No Drawings

COLOR PHOTOGRAPHIC RECORDING MATERIAL DEVELOPABLE BY HEAT

This application is a continuation of application Ser. No. 050,674 filed May 18, 1987, now abandoned.

This invention relates to a colour photographic recording material which is developable by heat, consisting of a layer support with a layer of binder containing, as additives to the layer, at least one colour providing compound and a silver halide emulsion having crystal zones of differing halide compositions, hereinafter briefly referred to as a zone emulsion. The zone emulsion improves the sensitivity, suppresses fogging and increases the range of conditions under which heat development may be carried out.

Heat developable photographic recording materials containing silver halide emulsions as light-sensitive additives have been described. A survey of the use of silver halide emulsions for thermographic processes in hydrophilic and hydrophobic media may be found, for example, in Research Disclosure 17029 (June 1978). In addition to forming the latent image, the silver halide may directly contribute to the formation of the image as metallic silver or it may serve as oxidizing agent for subsequent colour reactions. The colour providing compounds used may be inter alia conventional colour couplers or leuco dye bases which give rise to a dye image on oxidation.

Especially suitable colour providing compounds are those which can be incorporated in the layer of a photographic material in a non-diffusible form and are capable of releasing a diffusible dye as a result of development (dye releasing compounds). The special suitability of such dye releasing compounds is due to the fact that the dyes which are released imagewise can be transferred to special image receptor layers to form a brilliant colour image on which no unwanted image silver or silver halide is superimposed and which therefore requires no after-treatment. An advantageous rapid process for the production of colour images is thus obtained by combining the heat development process with the dye diffusion process. A suitable recording material for this purpose is described, for example, in DE-A-3 215 485.

According to the said publication, a recording material having a layer containing a combination of a silver halide, silver benzotriazolate, a dye releasing compound and guanidine trichloroacetate (base donor) is exposed imagewise and then subjected to a heat treatment in contact with an image receptor sheet so that the dye which has been released imagewise is transferred to the image receptor sheet. The production of multicolour images requires the use of several such combinations in each of which the silver halide is sensitive to a different spectral region of light and is associated with a dye releasing compound corresponding to its spectral sensitivity. The said dye releasing compound releases a dye of a different colour, in most cases a colour which is complementary to the colour of light to which the associated silver halide is predominantly sensitive. Such associations may be arranged in several layers one above the other.

Silver halide emulsions used in thermographic dye diffusion processes are mentioned in EP-A-0 123 913. The said document describes silver halide emulsions having an iodide content of from 4 to 40 mol-% in the form of mixed crystals. According to X-ray diffraction diagrams, the emulsions have no zones containing pure silver iodide. the rapid development kinetics and high sensitivity of the emulsions are particularly mentioned.

The image fog, however, is not without problems and is in many cases too high. This becomes particularly evident under exposure to head which may result in a distinct increase in the fogging values, for example when processing times are prolonged. Tte range of processing conditions for such a material is thereby severely restricted so that it is, of course, more difficult to obtain uniform results in the production of the image. The sensitivity of such recording materials also leaves room for improvement.

It is an object of the present invention to provide a photothermographic recording material which has a low fog level. Another object of this invention consists of providing a heat developable photographic recording material which has high stability to fogging so that the material is less susceptible to fluctuations in the process. It is another object of the invention to provide a recording material with improved $D_{min}/D_{max}$ratio. Yet another object of the invention is the production of a recording material with improved sensitivity.

These objects and advantages of the invention are obtained by photothermographic recording materials containing silver halide emulsions in which the grains have at least three zones of differing halide compositions (as explained below) and in which the transition from any one zone to an adjacent zone may be either continuous or stepwise. In the simplest case, the grains comprise a core, an outer shell and a third zone arranged between these two although two, three or more zones may be arranged between the core and the outer shell. Each zone differs from the immediately adjacent zone or zones by its particular halide composition. By "zone" is meant a coherent region extending over at least 0.5 mol-% of the entire silver halide of each grain and in which the silver halide composition is substantially constant. The silver halide composition may have a gradient at the boundaries between two adjacent zones. The boundary is in that case defined as having a silver halide composition corresponding to the mean value of the silver halide compositions in the homogeneous regions of the two adjacent zones.

The individual zones may contain inclusions of a different composition, in particular inclusions with a higher iodide content. The halide may in each zone be a chloride, bromide or iodide or mixtures thereof. If the iodide content follows a gradient, then according to a preferred embodiment the iodide content in the core or in the surroundings of the core is higher than in more externally situated zones. In another preferred embodiment, the core consists substantially of silver bromide and the outermost zone of a silver iodobromide emulsion with a relatively small iodide content, e.g. in the region of 0 to 10 mol-%, and at least one intermediate zone consists of a silver iodobromide emulsion with a relatively high silver iodide content, in particular at least 5 mol-%. According to a particularly preferred embodiment, at least one zone situated between the core and the outermost shell contains a silver iodobromide emulsion with an iodide content of 7 to 40 mol-%.

In another preferred embodiment, the silver halide grains have at least three successive zones from the surface of the grain to its centre differing in their halide composition and the local iodide content assumes a maximum at least at one point situated neither on the surface nor in the centre, and the difference between the iodide content in the zone with the highest iodide content and the iodide content in the zone of lowest iodide content situated nearer the outer shell of the grain is at least 6 mol-%, preferably at least 8 mol-%, and in a particularly preferred embodiment this difference in iodide content is at least 9 mol-% and the molar proportion (molar fraction) of the zones in which the iodide content assumes a maximum is from 10 to 60%, preferably from 15 to 50% and most preferably from 20 to 40%.

If the emulsions used are predominantly chlorobromide emulsions, then according to a preferred embodiment the interior of the grain has at least one zone in which the chloride content is higher than in the adjacent zones the overall chloride content of these emulsions is preferably in the range of 0.5 to 95 mol-% and the maximum local chloride content from 20 to 100 mol-5.

The average diameter of spheres having a volume equal to the volume of the silver halide grains of the silver halide emulsions to be used according to the invention is preferably from 0.15 um to 2.3 um, in particular from 0.2 um to 1.3 um.

The silver halide grains may have any habit, e.g. they may be cuboid, octahedral, tetradecahedral, etc.

In a preferred embodiment, the grains are predominantly compact crystals, e.g. of a cuboid or octahedral form or transitional form. They may be characterised in that their thickness is mainly greater than 0.15 um. The average ratio of diameter to thickness is preferably less than 8:1, the diameter of the grain being defined as the diameter of a circle whose area is equal to the projected area of the grain.

The edges and corners of the silver halide grains may be rounded off and the grains may have one or more twin planes and they may have recesses on at least one surface or warts. The grain size distribution of the silver halide grains may be monodisperse, oligodisperse or polydisperse.

The silver halide emulsions may be prepared by the usual methods (e.g. single inflow or double inflow with constant or accelerated rate of feed). Preparation by the double inflow process with controlled pAg is particularly preferred; see Research Disclosure 17643 (December 1978), Sections I and II. Photographically active compounds such as compounds of copper, thallium, lead, bismuth, cadmium, ruthenium, rhodium, palladium, osmium, iridium, platinum, gold, sulphur, selenium or tellurium may be present during precipitation.

The emulsions are preferably chemically sensitized to a high surface sensitivity on the surface of the grains but at least one of the interior zones may also be chemically sensitized before grain growth is completed. The known methods of chemical sensitization may be employed, e.g. sensitization with active gelatine or with compounds of sulphur, selenium, tellurium, gold, palladium, platinum or iridium, at pAg values which may vary from 4 to 10 and pH values from 3.5 to 9 at temperatures from 30° C. to 90° C. Chemical sensitization may be carried out in the presence of heterocyclic nitrogen compounds such as imidazoles, azindenes, azapyridazines, azapyrimidines, thiocyanate derivatives, thioethers and other silver halide solvents. Instead of or in addition to such chemical sensitization, the emulsions according to the invention may be subjected to a reduction sensitization, e.g. by means of hydrogen or a low pAg (e.g. below 5) and/or high pH (e.g. above 8) or by means of reducing agents such as tin(II) chloride, thiourea dioxide and aminoboranes.

The surface ripening nuclei may be present as troglodyte nuclei (sub-surface nuclei) according to DE-A-2 306 447 and US-A-3 966 476. Other methods are described in research Disclosure 17643, Section III.

The emulsions may be oxidized during and/or after precipitation and before, during and/or after chemical ripening, e.g. with iron(III) compounds, mercury(II) compounds or N-(m-nitrobenzyl)-quinolinium chloride.

The emulsions may be spectrally sensitized in a known manner, e.g. with the usual polymethine dyes such as neutrocyanines, basic or acid carbocyanines, rhodacyanines, hemicyanines, styryl dyes, oxonoles and the like. Sensitizers of this kind have been described by F.M.Hamer in "The Cyanine Dyes and related Compounds", (1964); see also in particular Ullmanns Enzyklopadie der technischen Chemie, 4th Edition, Volume 18, pages 431 et seq and Research Disclosure 17 643, Section IV. Spectral sensitization may be carried out any any stage in the preparation of the emulsion, i.e. during or after silver halide precipitation and before, during or after chemical sensitization.

The colour photographic recording materials normally contain at least one silver halide emulsion layer unit for each of the three spectral regions, red, green and blue.

The emulsions described above are eminently suitable for use in photothermographic recording materials, in which they are distinguished by their high development kinetics, low minimum densities, high maximum density and high sensitivity.

The quantity of light-sensitive silver halide may vary from 0.01 to 3.0 g per $m^2$ in each layer of the whole arrangement, the quantity of silver halide used in any particular layer or material depending on the requirements of the reactants and on the desired effects.

The emulsions according to the invention may be mixed with one another or with other emulsions. Organic silver salts may also be added to act as accelerators for the heat development. Suitable compounds include, for example, the silver salts of aliphatic and aromatic carboxylic acids. Silver salts of compounds containing a mercapto or thio group may also be used, as may the silver salts of compounds containing imino groups. In preferred examples, these include silver salts of benzotriazole and its derivatives such as, for example, alkyl-, hydroxy-, sulpho- or halogen- substituted benzotriazoles. The molar quantity of organic silver salt compound added may be equal to, greater than or less than the molar quantity of silver halide compound and should be adjusted to the particular requirements of the combination of layers.

Anti-foggants and stabilizers may be used for the silver halide emulsions according to the invention. It is advantageous to use fog-reducing compounds corresponding to the following formula I

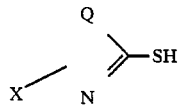

I wherein

Q denotes a group required for completing a heterocyclic group having at least one 5-membered or 6-membered heterocyclic ring and X denotes a carboxylic or sulphonic acid group or a group containing a carboxylic or sulphonic acid group, the said caroboxylic acid or sulphonic acid group being optionally in an anionic form, e.g. as the alkali metal, alkaline earth metal or ammonium salt or the salt of an organic base, such as a trialkyl or tetraalkylammonium salt.

Particularly advantageous fog reducing compounds are those corresponding to the general formula II

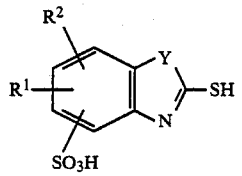

II wherein

Y stands for O, S, Se or $NR^3$, $R^1$ and $R^2$, which may be identical or different, denote hydrogen, alkyl, preferably with up to 6 carbon atoms such as methyl or ethyl, alkenyl such as allyl, cycloalkyl such as cyclohexyl, aryl such as phenyl, aralkyl such as benzyl or halogen such as Cl or Br, or $R^1$ and $R^2$ together denote a condensed benzene ring, and $R^3$ denotes hydrogen, alkyl, preferably with up to 6 carbon atoms such as methyl or ethyl, alkenyl such as allyl, cycloalkyl such as cyclohexyl, aralykyl such as benzyl or aryl such as phenyl, and the groups mentioned may be further substituted, e.g. with hydroxyl, alkoxy or halogen.

The above-mentioned heterocyclic mercaptoazole carboxylic acids and mercaptoazole sulphonic acids are known compounds and methods for their preparation have been described in the relevant literature.

Another essential component of the photothermographic recording material according to the invention is a nondiffusible, colour providing compound. This is capable of relasing a diffusible dye as a result of a redox reaction which takes place during development. It will hereinafter be referred to as a dye releasing compound.

The dye releasing compounds used according to this invention may be any of numerous types of compounds which are all distinguished by a connecting member which is redox dependent in the strength of its bond and which links a dye residue to a carrier group containing a ballast group.

See in this connection a summarizing account of this field in Angew. Chem. Int. Ed. Engl. 22 (1983), 191 - 209, in which the most important of the known systems are described. Redox active dye releasing compounds of the formula

BALLAST - REDOX - DYE are found to be particularly advantageous. In this formula, BALLAST denotes a ballast group, REDOX denotes a redox active group, i.e. a group which is oxidizable or reducible under the conditions of alkaline development and which, depending on whether it is in the oxidized or the reduced state, will undergo to varying extends an elimination reaction, a nucleophilic displacement reaction, hydrolysis or some other decomposition reaction in which the DYE residue is split off, and DYE denotes the residue of a diffusible dye, e.g. a yellow, magenta or cyan dye, or the residue of a dye precursor.

A group may be regarded as a ballast group if it enables the dye releasing compound according to the invention to be incorporated in a diffusion-fast form in the hydrophilic colloids conventionally used in photographic materials. These ballast groups are preferably organic groups generally containing straight chained or branched aliphatic groups with, generally, 8 to 20 carbon atoms and optionally also carbocyclic or heterocyclic, optionally aromatic groups. These groups are attached to the remainder of the molecule either directly or indirectly, e.g. through one of the following groups: NHCO, $NHSO_2$, NR (in which R denotes hydrogen or alkyl), O or S. The ballast group may in addition contain water-solubilizing groups, e.g. sulpho groups or carboxyl groups, and these may also be present in an anionic form. Since the diffusion properties depend on the molecular size of the whole compound, it is in some cases sufficient to use shorter chained groups as ballast groups, e.g. if the molecule as a whole is large enough.

Redox active carrier groups having the structure BALLAST-REDOX- and suitable dye releasing compounds are known in various forms. A detailed description need not be given here in view of the survey given in the above-mentioned article in Angew. Chem. Int. Ed. Engl. 22 (1983) 191-209.

Some examples of redox-active carrier groups from which a dye residue is split off in accordance with a previous imagewise oxidation or reduction are given below purely for the purpose of illustration:

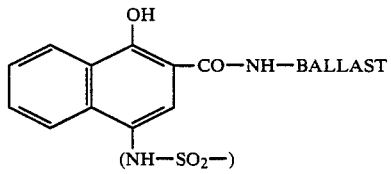

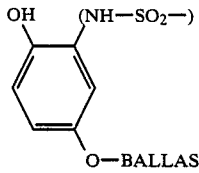

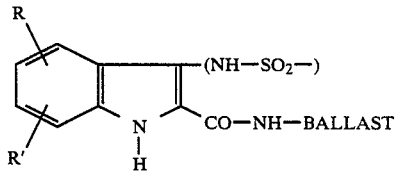

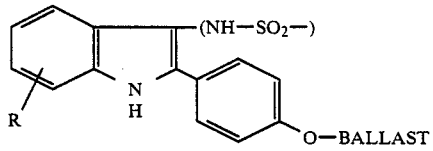

-continued

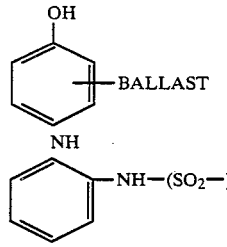

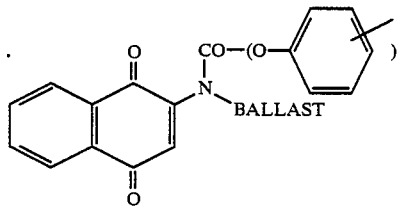

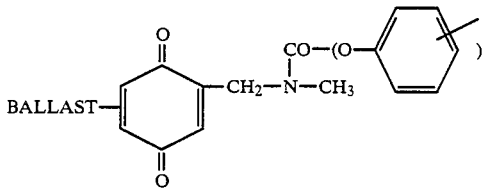

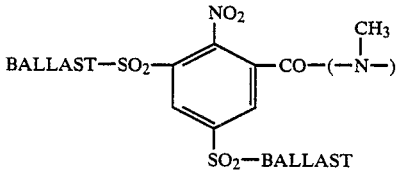

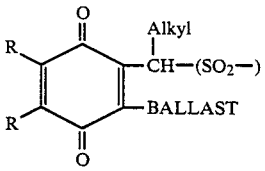

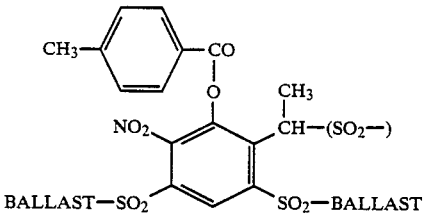

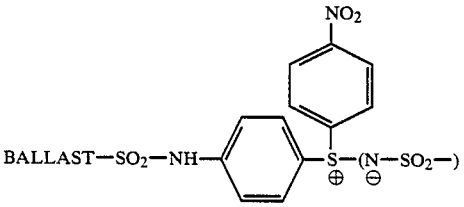

The groups in brackets are the functional groups of the dye residue and are split off together with this residue from the remaining part of the carrier group. The functional group may be a substituent whch may have a direct influence on the absorption properties and possibly also complex forming properties of the released dye. On the other hand, the functional group may be separated from the chromophore of the dye by an intermediate or linking member. Finally, the functional group may be of some importance together with the intermediate member in determining the diffusion and mordanting properties of the released dye. Alkylene and arylene groups, for example, are suitable intermediate members.

The dye residues may in principle be residues of any classes of dye, provided they are sufficiently diffusible to diffuse out of the light-sensitive layer of the light-sensitive material into an image receptor layer. The dye residue may carry one or more alkali solubilizing groups for this purpose. Alkali solubilizing groups suitable for this purpose include inter alia carboxyl groups, sulpho groups, sulphonamide groups and aromatic hydroxyl groups. Alkali solubilizing groups of this kind may be preformed in the dye releasing compounds used according to the invention or they may result from the separation of the dye residue from the carrier group which carries ballast groups. The following dyes are particularly suitable for the process according to the invention: Azo dyes, azomethine dyes, anthraquinone dyes, phthalocyanine dyes, indigoid dyes and triphenylmethane dyes, including dyes which have undergone or are capable of undergoing complex formation with metal ions.

The dye precursor residues are residues of compounds which are converted into dyes by photographic processing in particular under the conditions of heat development, either by oxidation or by coupling or by complex formation or by exposure of an auxochromic group in a chromophoric system, for example by saponification. The dye precursors in this sense may be leuco dyes, couplers or dyes which are converted into other dyes in the course of the processing. In cases where it is not important to make a distinction between dye residues and residues of dye precursors, the term "dye residues" will be used to include dye precursor residues.

Suitable dye releasing compounds have been described, for example, in the following documents: US-A-3 227 550, US-A-3 443 939, US-A-3 443 940, DE-A-1 930 215, DE-A-2 242 762, DE-A-2 402 900, DE-A-2 406 664, DE-A-2 505 248, DE-A-2 543 902, DE-A-2 613 005, DE-A-2 645 656, DE-A-2 809 716, DE-A-2 823 159, BE-A-861 241, EP-A-0 004 399, EP-A-0 004 400, DE-A-3 008 588, DE-A-3 014 669 and EP-A-0 038 032.

The dye releasing compounds may be present in an oxidizable form or capable of coupling in some embodiments of the heat development process according to the invention whereas in others they may be present as reducible dye releasing compounds. The copy obtained from the original when a conventional negative silver halide emulsion is used is either a negative or a positive copy, depending on whether the dye is released from the oxidized or the reduced form of dye releasing compound. It is therefore possible to produce either positive or negative images as desired by suitable choice of the dye releasing system.

Oxidizable dye releasing compounds particularly suitable for the heat developable recording materials according to the invention are described, for example, in DE-0A-2 645 656.

If the dye releasing compound is oxidizable then it is itself a reducing agent which is oxidized by the imagewise exposed silver halide, either directly or with the aid of electron transfer agents (ETA). An imagewise differentiation is then obtained with regard to the capacity to release diffusible dyes. If, on the other hand, the dye releasing compound is reducible, then it is suitably used in combination with a limited quantity of reducing agent, a so-called electron donor compound or an electron donor precursor compound which in this case is present side by side with the dye releasing compound and lightsensitive silver halide in the same layer of binder. The use of electron transfer agents may also be advantageous when reducible dye releasing compounds are used in combination with electron donor compounds.

For the production of positive colour images from positive originals when using negative silver halide emulsions it is suitable to sue, for example, a recording material according to the invention containing reducible dye releasing compounds containing a carrier moiety corresponding to the following formula:

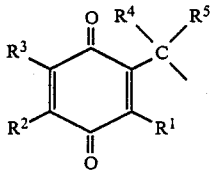

"Carquin"

wherein $R^1$ denotes alkyl or aryl, $R^2$ denotes alkyl, aryl or a group which together with $R^3$ completes a condensed ring, $R^3$ denotes hydrogen, alkyl, aryl, hydroxyl, halogen such as chlorine or bromine, amino, alkylamino, dialkylamino, including cyclic amino groups (such as piperidino or morpholino), acylamino, alkylthio, alkoxy, aroxy, sulpho or a group which together with $R^2$ completes a condensed ring, $R^4$ denotes alkyl and $R^5$ denotes alkyl or, preferably, hydrogen, and at least one of the groups $R^1$ to $R^4$ is a ballast group.

The electron donor compound used in combination with a reducible dye releasing compound serves as reducing agent both for the silver halide and for the dye releasing compound. Since the silver halide and the dye releasing compound compete with each other in the oxidation of electron donor compound but the former is more vigorous in its action than the latter, the silver halide present determines, in accordance with a preceding imagewise exposure, the areas of image within which the dye releasing compound is reduced by the electron donor compound.

The electron donor compound which is present in limited quantity is oxidized under the conditions of development, e.g. when the imagewise exposed colour photographic recording material is heated, the amount of oxidation depending on the degree of exposure, and the electron donor compound is then no longer available for a reaction with the dye releasing compound. An imagewise distribution of unused electron donor compound is then obtained.

Examples of compounds which have been described as electron donor compounds include non-diffusible or only slightly diffusible derivatives of hydroquinone, of benzisoxazolone, of p-aminophenol and of ascorbic acid (e.g. ascorbyl palmitate) (DE-A-2 809 716).

Further examples of electron donor compounds have been disclosed in DE-A-2 947 425, De-A-3 006 268, DE-A-3 130 842, DE-A-3 144 037, DE-A-3 217 877 and EP-A-0 124 915 and Research Disclosure 24 305 (July 1984). It has been shown that the above-mentioned electron donor compounds also satisfy the requirements under the conditions of thermal development and are therefore suitable for use as electron donor compounds for the purpose of the present invention. Particularly suitable are those electron donor compounds which are formed in the layer from the corresponding precursors under the conditions of heat development, i.e. electron donor compounds which prior to development are only present in a masked form in the recording material and therefore virtually inactive but are converted into their active form under the conditions of heat development, for example by the removal of certain protective groups by hydrolysis. In the present case, the electron donor precursor compounds mentioned are also regarded as electron donor compounds.

In another embodiment, the dye releasing compounds used may be capable of coupling and of releasing a diffusible dye as the result of a coupling reaction. This covers two possibilities. In the first case, the dye is formed by chromogenic coupling in which a diffusion inhibiting ballast group is split off from the coupling position. In the second case, a non-diffusible coupler contains a preformed dye residue as fugitive group in the coupling position and this fugitive group is split off by the coupling reaction and thus becomes diffusible. Systems of this kind have been described, for example, in US-A-3 227 550. The dye releasing compounds may consist of polymeric couplers which are released from the dye, as described, for example, in DE-A-3 422 455.

The above-mentioned essential components of the recording material according to the invention, namely the special silver halide emulsion and the dye releasing compound, optionally in combination with an electron donor compound, are present side by side, dispersed in a binder. The binder may be a hydrophobic or a hydrophilic binder, but the latter is preferred. The binder used for the light-sensitive layer is preferably gelatine although this may be partly or completely replaced by other natural or synthetic binders. Examples of natural binders include alginic acid and its derivatives such as salts, esters or amides, cellulose derivatives such as carboxymethyl cellulose, alkyl celluloses such as hydroxyethyl cellulose, starch and its derivatives and carrageenates. Polyvinyl alcohol, partially saponified polyvinyl acetate and polyvinyl pyrrolidone are examples of suitable synthetic binders.

Examples of hydrophobic binders include polymers obtained from polymerisable ethylenically unsaturated monomers such as alkyl acrylates, alkyl methacrylates, styrene, vinyl chloride, vinyl acetate, acrylonitrile and acrylamides. Polyesters, polyurethane compounds and waxes may also be used. Polymers of this kind may, for example, be used in their latex form.

For the production of monochrome colour images, the light-sensitive layer of binder contains one or more dye releasing compounds associated with the lightsensitive silver halide, and dyes of a particular colour are released from these dye releasing compounds. The colour finally obtained may be the resultant of mixing several dyes so that black-and-white images may be produced by means of an accurately adjusted mixture of several dye releasing compounds of different colours. For the production of multicolour images, the colour photographic recording material of the present invention contains several, i.e. generally three associations of dye releasing compound with silver halide in each case sensitized to a different region of the spectrum, the absorption range of the dye released from the dye releasing compound generally corresponding substantially to the region of spectral sensitivity of the associated silver halide. The various associations of dye releasing compound with silver halide may be accommodated in different layers of binder in the colour photographic recording material, and the different layers of binder are preferably separated by separating the layers consisting of a water-permeable binder such as gelatine containing, for example, a scavenger for developer oxidation products, these separating layers serving mainly to separate the different associations from one another to counteract falsification of the colour. In such cases, the colour photographic recording material according to the present invention may contain, for example, a light-sensitive layer of binder which contains a cyan dye releasing compound and in which the silver halide has been rendered predominantly red-sensitive by spectral sensitization, another light-sensitive layer of binder which contains a magenta dye releasing compound and in which the silver halide has been rendered predominantly green-sensitive by spectral sensitization and a third light-sensitive layer of binder which contains a yellow dye releasing compound and in which the silver halide is predominantly blue-sensitive either by virtue of its intrinsic sensitivity or as a result of spectral sensitization.

In another embodiment of the present invention, each of the above mentioned associations of lightsensitive silver halide and dye releasing compound is used in the form of a so-called complex coacervate. By "complex coacervate" is meant a form of dispersion in which a mixture of the main components is enclosed in a common shell of hardened binder. Dispersions of this kind are also referred to as packet emulsions and they are obtained by complex coacervation.

Methods for the preparation of a packet emulsion in which a colour producing substance is incorporated by complex coacervation are described, for example, in US-A-3 276 869 and US-A-3 396 026. The use of packet emulsions in heat developable recording materials is described, for example, in DE-A-32 32 674.

The use of packet emulsions according to the invention enables several emulsion components differing in their respectral sensitivity, including the corresponding dye releasing compounds, to be accommodated in a single layer of binder without the spectral association being thereby lost and therefore without colour falsification. This is possible because the amount of exposure of a given silver halide particle almost entirely determines the amount of dye released from that dye releasing compound which is present in the same coacervate particle (packet) as the silver halide. Packet emulsions therefore enable a blue-sensitive, a green-sensitive and a red-sensitive silver halide emulsion and the corresponding associated dye releasing compounds to be all accommodated in the same layer of binder without any risk of serious colour falsification.

In addition to the components already mentioned above, the colour photograpic material according to the invention may contain other components and auxiliary substances which may be helpful, for example, for the heat treatment and the resulting colour transfer. These additional components and auxiliary substances may be accommodated in a light-sensitive layer or in a light-insensitive layer.

These auxiliary substances may consist, for example, of auxiliary developers which generally have developing properties for exposed silver halide. In the present case they mainly serve to promote the reaction between the exposed silver halide and the reducing agent. If an oxidizable dye releasing compound is used, then the reducing agent may be identical to the dye releasing compound whereas a reducible dye releasing compound may react with the reducing agent. Since this reaction mainly consists in a transfer of electrons, the auxiliary developers are also referred to as electron transfer agents (ETA).

The following are examples of suitable auxiliary developers: Hydroquinone, pyrocatechol, pyrogallol, hydroxylamine, ascorbic acid, 1-phenyl-3-pyrazolidone and derivatives thereof, e.g. 4-methyl-1-phenyl-3-pyrazolidone, 4,4-dimethyl-1-phenyl-3-pyrazolidone, 4-hydroxymethyl-4-methyl-1-phenyl-3-pyrazolidone, 4-hydroxymethyl-4-methyl-1-tolyl-3-pyrazolidone and 4,4-dihydroxymethyl-1-phenyl-3-pyrazolidone. In certain cases, it is advantageous to use these auxiliary developers in a masked form carrying a protective group which can be split off by alkalies. Since these auxiliary developers have a catalytic action, they need not be present in stoichiometric quantities and it is generally sufficient to use up to ½ mol of auxiliary developer per mol of dye releasing compound in the layer. These compounds may be incorporated in the layer from solutions in aqueous solvents, for example, or in the form of aqueous dispersions obtained with the aid of oil formers.

For coupling colour systems, it is necessary to use colour developers, such as, for example, the usual phenylene diamine developers or aminophenols. For reasons of stability, it is advantageous to use the developer additive in a masked form carrying a protective group which is subsequently split off under the conditions of processing.

The auxiliary substances may also include compounds for activating development, such as bases or base precursors, i.e. compounds with a pka-value of 8 or more. the inorganic bases may be, for example, hydroxides, tertiary phosphates, borates, carbonates of alkali metals or alkaline earth metals, or ammonium hydroxide. Examples of suitable organic bases include aliphatic amines, heterocyclic amines, amidines, cyclic amidines, guanidines and cyclic guanidines.

By "base precursor" are meant compounds which are capable of releasing a base component when heated. These precursors may be salts of the above-mentioned bases with organic acids which are decomposed by heat, such as trichloroacetic acid, acetoacetic acid, cyanoacetic acid, sulphonylacetic acid or acetylene carboxylic acids. Base precursors in which the base is attached by a covalent bond and which release the base in the heat, for example by a fractionating reaction, are also advantageous; see the hydroxamic acid carbonates mentioned in EP-A-0 120 402 and aldoxime carbamates mentioned in EP-A-0 118 078.

The auxiliary substances may also be compounds which are capable fo releasing water under the action of heat. These include, in particular, inorganic salts containing water of crystallisation, e.g. $Na_2SO_4.10H_2O$ or $NH_4Fe(SO_4)_2.12H_2O$.

The water released on heating promotes the processes of development and diffusion required for production of the image.

Other auxiliary substances include, for example, the so-called thermal solvents. These are generally nonhydrolysable organic compounds which are solid under normal conditions but melt when heated to the temperature of the heat treatment to form a liquid medium in which the development processes can take place more rapidly. Such thermal solvents may, for example, function as diffusion accelerators. Preferred examples of thermal solvents include polyglycols such as those described in US-A-3 347 675, e.g. polyethylene glycol with an average molecular weight of from 1500 to 20,000, derivatives of polyethylene oxide such as its oleic acid esters, beeswax and monostearin. Compounds which have a high dielectric constant and contain a $SO_2$ or CO group, for example, are suitable.

See in this connection the thermal solvents mentioned in Patent Specification EP-A-0 119.615 which lists ureas, pyridines, pyridine-N-oxides, carboxylic acid amides, imides, sulphonamides, polyhydric alcohols, oximes, pyrazoles and imidazoles.

Development accelerators may also serve as useful auxiliary substances, for example the sulphonamides described in EP-A-0 160 313 and DE-A-3 339 810.

Certain additives which lower the pH and serve mainly to stabilize the minimum densities may also be used. .Acid precursor compounds such as those described in DE-A-3 442 018 and DE-A-3 515 176 are suitable for this purpose.

Development of the imagewise exposed colour photographic recording material according to the invention covers the steps of silver halide development, production of an imagewise distribution of diffusible dye and transfer by diffusion of this imagewise distribution to the image receptor layer. The process is initiated by subjecting the exposed recording material to a heat treatment in which the light-sensitive layer arrangement is heated to a temperature e.g. in the region of 80 to 250° C. for about 0.5 to 300 seconds. This treatment creates suitable conditions in the recording material for the development processes, including dye diffusion, without the aid of a liquid medium, e.g. in the form of a developer bath. Development releases diffusible dyes in imagewise distribution from the dye releasing compounds and transfers them to an image receptor layer which may be either an integral component of the colour photographic material according to the invention or it may be in contact with such a material at least during the time of development. Imagewise development of silver, release of dye and colour transfer thus take place synchronously in a single-step development process.

Production of the colour image with the colour photographic recording material according to the invention may also take place as a two-step development process in which silver halide development and release of dye take place in a first step whereupon transfer of the colour image from the light-sensitive part to an image receptor part in contact therewith takes place in a second step, e.g. by heating to a temperature of 50° to 150° C., preferably 70° to 90° C., in which case diffusion auxiliaries (solvents) may be applied externally before the lightsensitive part is laminated to the imnage receptor part.

The image receptor layer may thus be arranged on the same layer support as the light-sensitive element (single sheet material) or on a separate layer support (two sheet material). It consists substantially of a binder containing the mordant for fixing the diffusible dye released from the non-diffusible dye releasing compounds. The mordants for anionic dyes are preferably long chained quaternary ammonium or phosphonium compounds, e.g. of the kind described in US-A-3 271 147 and in US-A-3 271 148.

Certain metal salts and their hydroxides which form difficultly soluble compounds with the acid dyes may be used, as may also polymeric mordants such as those described in DE-A-2 315 304, DE-A-2 631 521 or DE-A-2 941 818. Preferred mordants also include polyvinyl imidazole mordants which are partially quaternized, for example with benzyl-, hydroxyethyl-, alkyl-, epoxypropyl-, propyl-, methyl- and ethyl halides. The degree of quaternisation in these compounds may be from 1 to 50%. The mordant layer contains the dye mordant as a dispersion in one of the usual hydrophilic binders, e.g. in gelatine, polyvinyl alcohol, polyvinyl pyrrolidone or partly or completely hydrolysed cellulose esters. Some binders may, of course, themselves function as mordants, e.g. polymers of nitrogen-containing, optionally quaternary bases such as N-methyl-4-vinylpyridines, 4-vinylpyridine or 1-vinylimidazole as described, for example, in US-A-2 484 430.

Other suitable mordanting binders include, for example, the quanyl hydrazone dervatives of alkyl vinyl ketone polymers as described, for example, in US-A-2 882 156 or guanyl hydrazone derivatives of acyl styrene polymers as described, for example, in DE-A-2 009 498. In general, however, the last-mentioned binders would only be used in combination with other binders, e.g. gelatine.

If the image receptor layer is kept in contact with the light-sensitive element after development has been completed, an alkali permeable, light-reflecting layer of binder containing pigment is generally placed between these two layers. This layer of binder serves as optical separation between the negative and the positive and as an aesthetically pleasing image background for the transferred positive colour image.

If the image receptor layer is arranged between the layer support and the light-sensitive element and is separated from the latter by a preformed light-reflecting layer, then the layer support must either be transparent so that the colour transfer image produced can be viewed through this layer or the light-sensitive element and the light-reflecting layer must together be removed from the image receptor layer to expose the later. The image receptor layer may, on the other hand, be arranged as the uppermost layer in an integral colour photographic recording material, in which case exposure may be carried out through the transparent layer support.

Integral layer units of light-sensitive element and image receptor element may contain stripping layers to enable the two layer elements to be separated.

The layer support used for the light-sensitive element and optionally for the image receptor element must be dimensionally stable at the processing temperature. The usual film supports or paper supports may be used for this purpose but polyester materials are preferred.

Both the light-sensitive element and the image receptor element may be hardened by means of the conventional hardeners used for photographic materials, including rapid or instant hardeners.

EXAMPLE 1 Preparation of the emulsions

Emulsion E1 (Comparison emulsion)

A silver iodobromide emulsion containing 88.3 mol-% of bromide and 11.7 mol-% of iodide was prepared by the double inflow process. The emulsion crystals were octahedral and the average diameter of spheres of equal volume was 0.475 um.

2000 ml of a 0.5-molar $AgNO_3$ solution and 2000 ml of a 0.5-molar KBr solution were added at pH 6.35 and 63° C. to 7 kg of an aqueous solution containing 230 g of gelatine, 0.8 g of potassium bromide and 45 g of 1-methylimidazole by the double inflow process with stirring.

300 mol of a 2-molar $AgNO_3$ solution and the quantity of a 2-molar $KBr_{0.87}I_{0.13}$ solution required to keep the pAg constant were then added at pAg 8.0 by the double inflow process. The speed of inflow was regulated to keep the pAg constant at 8.0. The pAg was subsequently raised to 10.2 by the addition of a 2-molar $KBr_{0.87}I_{0.13}$ solution at an inflow rate of 10 ml/min.

4200 ml of 2-molar $AgNO_3$ solution and the quantity of 2-molar $KBr_{0.87}I_{0.13}$ solution required to keep the pAg constant were then added at this pAg of 10.2 by the double inflow process.

The emulsion was then flocculated, washed and redispersed with 620 g of gelatine and the quantity of water required to make up the total weight of emulsion to 6.67 kg. The pAg was adjusted to 9.0 with 25% NaCl solution. The ratio of gelatine to $AgNO_3$ was 0.5 and the quantity of $AgNO_3$ per kg of emulsion was 254.8 g.

The emulsion was chemically ripened with 100 umol of $Na_2S_2O_3.5H_2O$, 30 μmol of $HAuCl_4$ and 1776 μmol of KSCN per mol of Ag and spectrally sensitized to the green or blue regions of the spectrum.

Emulsion E2 (according to the invention)

A silver chloroiodobromide emulsion consisting of 7 zones containing 4.0 mol-% of chloride, 88.7 mol-% of bromide and 7.3 mol-% of iodide was prepared by the double inflow process. The crystals were cubical and the average diameter of spheres of equal volume was 0.30 μm. 2000 ml of 0.5-molar $AgNO_3$ solution and 2000 ml of 0.5-molar KBr solution were added at pH 6.35 and 63° C. to 7 kg of an aqueous solution containing 230 g of gelatine, 0.8 g of potassium bromide and 14.5 g of 1-methylimidazole by the double inflow process with stirring.

300 ml of 2-molar $AgNO_3$ solution and the quantity of 2-molar KBr solution required to keep the pAg constant were then added by the double inflow process at pAg 8.0. The rate of inflow of the KBr solution was regulated to keep the pAg constant at 8.0. The pAg was subsequently lowered to 6.3 by the addition of 2-molar $AgNO_3$ solution at an inflow rate of 10 ml/min. At this pAg of 6.3, 200 ml of 2-molar $AgNO_3$ and the quantity of 2-molar $KCl_{0.5}Br_{0.5}$ solution required to keep the pAg constant were added by the double inflow process and 500 ml of 2-molar $AgNO_3$ solution and the quantity of 2-molar KBr solution required to keep the pAg constant were then added at the same pAg by the double inflow process. The pAg was then raised to 8.0 by the single inflow of 2-molar KBr solution at a rate of 10 ml/min, and subsequently 1800 ml of 2-molar $AgNO_3$ solution and the quantity of 2-molar $KBr_{0.8}I_{0.2}$ solution required to keep the pAg constant at 8.0 were added by the double inflow process. The pAg was then again lowered to 6.3 by the single inflow of 2-molar $AgNO_3$ solution at the rate of 10 ml/min. 200 ml of 2-molar $AgNO_3$ solution and the quantity of 2-molar $KCl_{0.5}Br_{0.5}$ solution required to keep the pAg constant were then added by the double inflow process at pAg 6.3, and finally 1500 ml of 2-molar $AgNO_3$ solution and the quantity of $KBr_{0.997}I_{0.003}$ required to keep the pAg constant at 6.3 were added by the double inflow process.

The emulsion obtained was flocculated, washed and redispersed with 620 g of gelatine and the quantity of water required to make up the total weight of the emulsion to 6.67 kg. The pAg was adjusted to 9.0 with 25% NaCl solution.

The ratio of gelatine:$AgNO_3$ was 0.5 and the quantity of $AgNO_3$ per kg of emulsion was 254.8 g.

The emulsion was chemically ripened at 53° C. with 39 μmol of $Na_2S_2O_3.5H_2O$, 14.7 μmol of $HAuCl_4$ and 870 μmol of KSCN per mol of Ag.

Emulsion E3 (according to the invention).

TABLE 1

| Zone | Composition of the emulsion crystals: Composition | Molar Fraction |
|---|---|---|
| 1 | AgBr | 0.1 |
| 2 | AgBr | 0.06 |
| 3 | $AgCl_{0.50}Br_{0.50}$ | 0.04 |
| 4 | AgBr | 0.1 |
| 5 | $AgBr_{0.80}I_{0.20}$ | 0.36 |
| 6 | $AgCl_{0.50}Br_{0.50}$ | 0.04 |
| 7 | $AgBr_{0.997}I_{0.003}$ | 0.30 |

An aqueous silver nitrate solution and potassium bromide solution were introduced in measured quantities into a 2.1% genatine solution over a period of 15 minutes at a temperature of 63° C. by pAg-controlled double inflow. a precipitate of silver bromide nuclei having a narrow grain size distribution and a mean particle size of 0.24 μm was obtained. The size of the crystals of the nuclear precipitate was increased to 10.2 times the grain volume by a further simultaneous addition of KBr solution and silver nitrate solution in measured quantities. The pAg was kept constant at 5.2 during this phase of precipitation. The rate of dosing was increased as shown in Table 2 below.

TABLE 2

| Time [min] | Rate of addition $AgNO_3$ solution | [ml/min] KBr solution |
|---|---|---|
| 0 | 27.6 | 26.8 |
| 3 | 35.4 | 34.3 |
| 8 | 41.8 | 40.5 |
| 15 | 53.2 | 51.6 |
| 25 | 66.5 | 64.5 |
| 37 | 75.7 | 73.4 |
| 51 | 90.4 | 87.7 |
| 68 | 105.8 | 102.6 |
| 92 | 105.8 | 102.6 |

An AgCl shell was precipitated on the existing crystals by a further pAg-controlled double inflow of a KCl solution and a silver nitrate solution. Emulsion precipitation was then continued by the double inflow of KBr and $AgNO_3$ solutions so that an AgBr shell was applied to the previously precipitated layer of AgCl. The mean particle diameter of the resulting zoned emulsion was 0.73 μm, with 14% of the crystals having measurements outside the range of 0.73 μm ±10%, i.e. the emulsion prepared was homodisperse. The chloride content was 4.8 mol-%, based on the total halide content.

The emulsion was freed from soluble salts in the usual manner by washing and then adjusted to pAg 7.8. The emulsion was then ripened at 48° C. for 90 minutes by the addition of sodium thiosulphate pentahydrate in a quantity of 40 μmol/mol of silver halide and 42.5 mg of a triazaindolizine. The emulsion was sensitized to the blue spectral region.

EXAMPLE 2

A light-sensitive element of a photothermographic recording material for the diffusion transfer process was prepared by application of the layers described below to a transparent layer support of polyethylene terephthalate. The quantities given refer to 1 $m^2$.

Layer 1

A layer containing a green-sensitized silver halide emulsion E1 of 0.5 g of $AgNO_3$ with 5 mg of 2-mercapto-5-sulphobenzimidazole, 0.3 g of dye releasing compound A Dye releasing compound A:

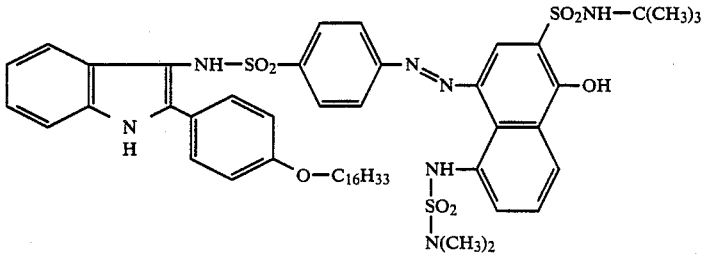

(emulsified in 0.15 g of diethyllauramide), 0.05 g of potassium bromide, 1 g of a polyester urethane (having the following composition:

84.1 % of a polyester of adipic acid, 1,6-hexanediol and neopentyl glycol, 13.1 % of hexamethylenediisocyanate and 2.5 % of N-aminoethyltaurine) and 1.5 g of gelatine.

Layer 2

A layer containing 1.5 g of guanidine trichloroacetate, 0.035 g of 4-methyl-4-hydroxymethyl-1-phenyl-3-pyrazolidone, 8 mg of sodium sulphite and 0.5 g of Compound B Compound B

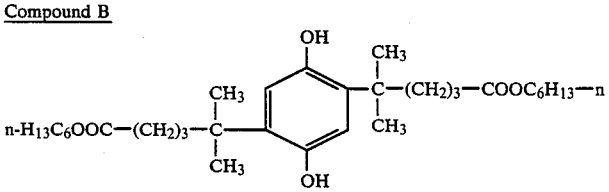

(emulsified in tricresylphosphate). 0.03 g of Compound C

Compound C

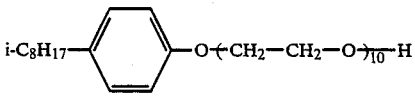

and 1.5 g of gelatine.

Layer 3

A protective layer containing 0.5 g of gelatine. The hardener is applied together with this protective layer.

The light-sensitive element prepared as described above was marked as Sample 1 and used as a Comparison sample. Another sample (Sample 2) was prepared by a similar method except that in this case Emulsion E1 in Layer 1 was replaced by Emulsion E2 with the same quantity of silver application.

An image receptor part for the photothermographic recording material was prepared by applying the following layers in succession to a layer support of a paper coated with polyethylene. The quantities given refer in each case to 1 $m^2$.

1. A mordant layer containing 2 g of polyurethane mordant obtained from 4,4'-diphenylmethane diisocyanate and N-ethyldiethanolamine quaternized with epichlorohydrin according to DE-A-2 631 521, Example 1; 0.035 g of Compound C and 2 g of gelatine.

2. A protective layer of 0.8 g of gelatine. Hardener was applied together with this layer.

Processing

One sheet of each light-sensitive element (Samples 1 and 2) was exposed through a step wedge. Development was carried out in two stages. In the first stage, the light-sensitive element was heated to 120° C. for 60 seconds by means of a heating plate on which the sample was placed with its active side in contact with the plate and the sample was then covered with another plate. In the second stage, the active side of the sample was brought into contact with the image receptor element which had previously been soaked in water. The set obtained by this procedure was then treated at 70° C. for 2 minutes by the same method as in the first step. The transfer of dye from the light-sensitive element to the image receptor element took place during this period. The two layer elements were then separated, and a magenta negative image of the exposed original was found on the image receptor element.

In another variation of the development procedure, the time of the first process step at 120° C. was reduced stepwise to 50 s, 40 s and finally 30 s.

The results of development of Samples 1 and 2 at different heating times are summarized in Table 3.

TABLE 3

| Sample | AgX | Heating 120° C. t[s] | $E_{rel}$ | $D_{min}/D_{max}$ |
|---|---|---|---|---|
| 1 | E1 | 60 | — | 1.75/2.35 |
| | | 50 | 2.76 | 0.70/2.35 |
| | | 40 | 1.86 | 0.21/2.22 |

TABLE 3-continued

| Sample | AgX | Heating 120° C. t[s] | $E_{rel}$ | $D_{min}/D_{max}$ |
|---|---|---|---|---|
| | | 30 | 1.26 | 0.13/1.88 |
| 2 | E2 | 60 | 2.30 | 0.24/2.25 |
| | | 50 | 2.26 | 0.22/2.33 |
| | | 40 | 1.99 | 0.23/2.27 |
| | | 30 | 1.57 | 0.14/2.01 |

E1: Comparison emulsion
E2: Emulsion according to the invention
$E_{rel}$: Relative sensitivity in long I x t units, higher values = higher sensitivity Table 3 shows that the amount of fogging of the emulsion according to the invention is considerably lower over a broad spectrum of processing conditions than in the comparison emulsion. the emulsion is therefore, above all, less sensitive to fluctuations in the process. On the other hand, the emulsion according to the invention is also shown to be more highly active over short processing periods than the comparison emulsion. This is manifested by the higher sensitivity and higher maximum density.

EXAMPLE 3

Example 2 was repeated but without the addition of 2-mercapto-5-sulphobenzimidazole to Layer 1. Samples 3 and 4 were obtained, Sample 3 containing the Comparison Emulsion E1 and Sample 4 containing Emulsion E2 according to the invention. The materials were processed as described in Example 2 using a processing time of 30 seconds in the first process step at 120° C. The development results are shown in Table 4. The improvement obtained with the emulsion according to the invention in Sample 4 compared with the Comparison emulsion in Sample 3 is seen particularly in the substantially lower fog level.

TABLE 4

| Sample | Emulsion | $D_{min}/D_{max}$ |
|---|---|---|
| 3 | E1 | 1.22/2.04 |
| 4 | E2 | 0.19/2.06 |

EXAMPLE 4

Example 2 was repeated but with the addition of a dispersion of silver benzotriazolate from 0.25 g of $AgNO_3$ to Layer 1 while the other applications to the layers were kept unchanged. Sample 5 contained Comparison Emulsion E1 and Sample 6 Emulsion E2 according to the invention. The results obtained when processing was carried out as described in Example 2 with a processing time of 60 seconds in the first step are summarized in Table 5.

TABLE 5

| Sample | AgX | $D_{min}/D_{max}$ |
|---|---|---|
| 5 | E1 | 1.50/2.15 |
| 6 | E2 | 0.23/2.10 |

This Example shows that the emulsion according to the invention has a high resistance to fogging even in the presence of development promoting additives such as silver benzotriazolate.

EXAMPLE 5

Example 2 was repeated but with the addition of dye releasing compound D instead of colour producing compound A to Layer 1. Sample 7 contained Comparison Emulsion E1 and Sample 8 contained Emulsion E2 according to the invention.

Dye releasing compound D

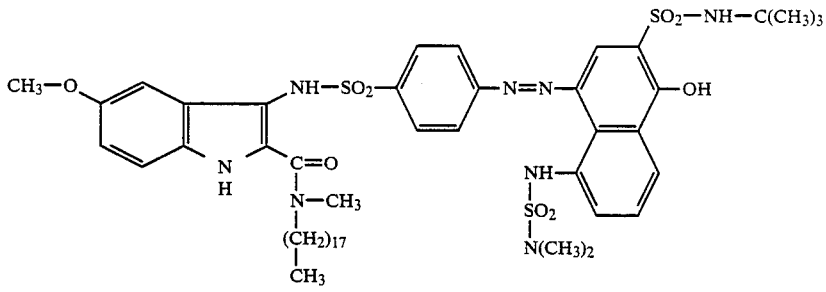

Processing was carried out as described in Example 2, with development times of 40 s, 30 s and 20 s in the first process step at 120° C. The development results are shown in Table 6.

TABLE 6

| Sample | Emulsion | 120° C. t [s] | $E_{rel}$ | $D_{min}/D_{max}$ |
|---|---|---|---|---|
| 7 | E1 | 40 | — | 1.36/2.04 |
| | | 30 | 1.65 | 0.50/1.80 |
| | | 20 | 0.50 | 0.22/1.00 |
| 8 | E2 | 40 | 2.25 | 0.28/2.00 |
| | | 30 | 1.91 | 0.25/1.76 |
| | | 20 | 1.00 | 0.22/1.23 |

Table 6 shows that Emulsion E2 according to the invention has significantly better fogging characteristics than Comparison Emulsion E1 or considerably improved sensitivity at comparable fog values.

EXAMPLE 6

A photothermographic recording material was built up from the following layers:

Layer 1

A layer containing a green-sensitized silver halide emulsion E1 of 1 g of $AgNO_3$ stabilized with 0.010 g of 2-mercapto-5-sulpho-benzimidazole and containing silver benzotriazolae obtained from 0.5 g of $AgNO_3$, 0.29 g of dye releasing compound E, 0.05 g of potassium bromide, 1 g of polyester urethane from Example 2 and 1.5 g of gelatine.

Dye releasing compound E

-continued

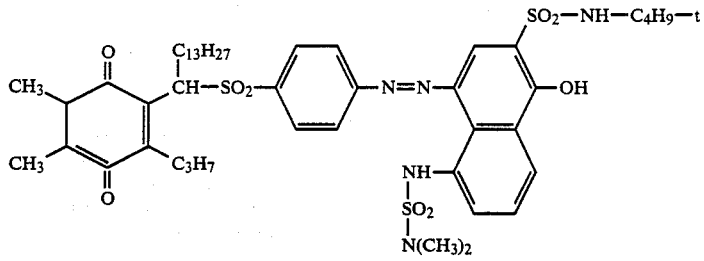

Layer 2

A layer containing 1.5 g of guanidine trichloroacetate, 0.24 g of 4-methyl-4-hydroxymethyl-1-phenylpyrazolidone, 0.06 g of sodium sulphite and 0.03 g of Compound C.

Layer 3

A protective layer similar to Layer 3 of Example 2.

This layer arrangement containing Emulsion E1 was marked as Sample 9. A similar arrangement of layers containing Emulsion E2 according to the invention was marked Sample 10.

The samples were processed at 120° C. for 60 seconds as described in Example 2. Since the colour system used in this case is a positive system, a reduction in emulsion fog is expressed as a higher colour density. Sample 9 containing Comparison Emulsion E1 had a density of D = 1.52 and Sample 10 containing Emulsion E2 according to the invention had a density of D = 1.62.

EXAMPLE 7

A photothermographic recording material was prepared from the following layers:

Layer 1

A blue-sensitized emulsion layer containing Comparison Emulsion E1 prepared from 0.5 g of $AgNO_3$, 0.005 g of 2-mercapto-5-sulphobenzimidazole, 0.26 g of dye releasing compound F emulsified in 0.13 g of diethyllauramide, 0.02 g of potassium bromide, 1 g of polyester urethane from Example 2 and 1 g of gelatine.

The light-sensitive element prepared as indicated above was marked Sample 11 and used as Comparison sample. Another Sample 12 was similarly prepared but with Emulsion E3 according to the invention in Layer 1 instead of Comparison Emulsion E1.

The material was processed as described in Example 2 but the processing time in the first step of the process at 120° C. was varied from 40 s to 20 s. The development results are summarized in Table 7.

TABLE 7

| Sample | Emulsion | 120° C. t [s] | $E_{rel}$ | $D_{min}/D_{max}$ |
|---|---|---|---|---|
| 11 | E1 | 40 | — | 1.63/1.80 |
| | | 30 | 2.45 | 0.93/1.77 |
| | | 25 | 1.90 | 0.33/1.46 |
| | | 20 | 1.51 | 0.17/1.25 |
| 12 | E3 | 40 | 2.71 | 0.35/1.80 |
| | | 30 | 2.43 | 0.27/1.70 |
| | | 25 | 2.03 | 0.21/1.24 |

This Example shows the high fogging stability of the emulsion according to the invention when exposed to a heat treatment which would lead to a high increase in fogging in the Comparison emulsion. At comparable $D_{min}/D_{max}$ values the emulsion according to the invention is also distinguished by its improved sensitivity.

We claim:

1. A colour photographic recording material developable by heat treatment, comprising at least one light-sensitive silver halide emulsion layer and a non-diffusible dye-releasing compound that release a diffusible dye associated therewith and containing in a light-sensitive layer or in a light-insensitive layer an organic base or base precursor as a development activating compound, wherein the silver halide grains in at least one silver halide emulsion layer consist mainly of silver bromide and silver iodide and have at least three zones differing in their local iodide content consisting of a core, an outermost shell and at least one intermediate zone between said core and said outermost shell; the local iodide content in the outermost shell is 0–10 mol-%; the local iodide content in at least one intermediate zone is Dye releasing compound F

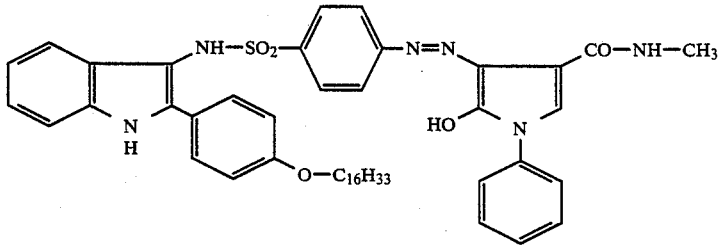

Layer 2

A layer containing 1.5 g of guanidine trichloroacetate, 0.035 g of 4-methyl-4-hydroxymethyl-1-phenyl-3-pyrazolidone, 0.008 g of sodium sulphite, 0.3 g of Compound B, 0.03 g of Compound C and 1.8 g of gelatine.

Layer 3

A protective layer containing 0.5 g of gelatine. The hardener was applied together with this layer.

higher than the local iodide content in the core and higher than the iodide content in the outermost shell; the maximum local iodide content in an intermediate zone is higher by at least 6 mol-% than the minimum local iodide content in a zone further away from the core.

2. The material as claims in claim 1, wherein in the silver halide grains the proportion of the intermediate zone of maximum local iodide content is from 10–60 mol %.

3. Recording material as claimed in claims 1 or 2, wherein the light-sensitive silver halide emulsion layer in addition contains a silver salt of an organic imino compound.

4. Recording material as claimed in claim 3, wherein the organic imino compound is benzotriazole or a benzotriazole derivative.

5. Recording material as claimed in claim 1, wherein the non-diffusible dye-releasing compound is capable of releasing a diffusible dye as a result of the development by heat treatment.

6. Recording material as claimed in claim 5, wherein the non-diffusible dye-releasing compound is an oxidizable colour providing compound which is capable of releasing a diffusible dye as a result of oxidation.

7. Recording material as claimed in claim 5, wherein the non-diffusible dye-releasing compound is a reducible colour providing compound capable of releasing a diffusible dye as a result of reduction.

8. Recording material as claimed in claims 1 or 2, comprising three combinations each consisting of a light-sensitive silver halide and a non-diffusible dye-releasing compound capable of releasing a diffusible dye, the silver halide having a different spectral sensitivity in each of the three combinations and the dye-releasing compound associated with the silver halide in each case giving rise to dye having an absorption range which substantially corresponds to the region of spectral sensitivity of the associated silver halide.

* * * * *